US011076237B2

(12) United States Patent
Cho et al.

(10) Patent No.: US 11,076,237 B2
(45) Date of Patent: Jul. 27, 2021

(54) SPEAKER MODULE HAVING INCLINED DIAPHRAGM AND ELECTRONIC DEVICE INCLUDING SAME

(71) Applicant: Samsung Electronics Co., Ltd., Suwon-si (KR)

(72) Inventors: Joonrae Cho, Suwon-si (KR); Yousang Nam, Suwon-si (KR); Choonghyo Park, Suwon-si (KR); Byounghee Lee, Suwon-si (KR); Hochul Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/658,729

(22) Filed: Oct. 21, 2019

(65) Prior Publication Data

US 2020/0145761 A1 May 7, 2020

(30) Foreign Application Priority Data

Nov. 5, 2018 (KR) ..... 10-2018-0134603

(51) Int. Cl.
*H04R 9/06* (2006.01)
*H04R 7/04* (2006.01)
(Continued)

(52) U.S. Cl.
CPC ..... *H04R 9/06* (2013.01); *H04R 1/028* (2013.01); *H04R 7/04* (2013.01); *H04R 7/18* (2013.01);
(Continued)

(58) Field of Classification Search
None
See application file for complete search history.

(56) References Cited

U.S. PATENT DOCUMENTS 10,462,272 B2 10/2019 Jung et al.
2017/0064436 A1 3/2017 Tamura et al.
(Continued)

FOREIGN PATENT DOCUMENTS

JP 2005-006141 A 1/2005
JP 2018-054983 A 4/2018
(Continued)

OTHER PUBLICATIONS

International Search Report dated Jan. 29, 2020, issued in International Patent Application No. PCT/KR2019/013832.

*Primary Examiner* — Kenny H Truong
(74) *Attorney, Agent, or Firm* — Jefferson IP Law, LLP

(57) ABSTRACT

A speaker module including an inclined diaphragm and to an electronic device is provided. The speaker module includes the speaker module, the speaker module including a yoke configuring one surface of the speaker module, a magnet including one surface arranged on an inner surface of the yoke, a frame configuring a side surface of the speaker module and including a first end portion connected to the yoke, a voice coil spaced apart from the magnet and including at least a portion overlapping the magnet, and a diaphragm comprising an inner surface on which the voice coil is arranged. The diaphragm is connected to a second end portion opposite to the first end portion of the frame and is inclined to be non-perpendicular to an outer surface of the frame, so that a sound in a high-frequency band output through the speaker module can be smoothly transmitted outside the electronic device.

8 Claims, 13 Drawing Sheets

(51) Int. Cl.
*H04R 7/18* (2006.01)
*H04R 1/02* (2006.01)
*H04R 9/02* (2006.01)

(52) U.S. Cl.
CPC ..... *H04R 9/025* (2013.01); *H04R 2400/11* (2013.01); *H04R 2499/11* (2013.01); *H04R 2499/15* (2013.01)

(56) References Cited

U.S. PATENT DOCUMENTS

| | | | | |
|---|---|---|---|---|
| 2019/0082262 | A1* | 3/2019 | Ilkorur ..... | H04R 7/18 |
| 2021/0021920 | A1* | 1/2021 | Choi ..... | H04R 1/2826 |

FOREIGN PATENT DOCUMENTS

| | | | |
|---|---|---|---|
| KR | 10-2008-0050093 | A | 6/2008 |
| KR | 10-2013-0056451 | A | 5/2013 |
| KR | 10-1395631 | B1 | 5/2014 |
| KR | 10-2018-0113421 | A | 10/2018 |

* cited by examiner

SPEAKER MODULE HAVING INCLINED DIAPHRAGM AND ELECTRONIC DEVICE INCLUDING SAME

CROSS-REFERENCE TO RELATED APPLICATION(S)

This application is based on and claims priority under 35 U.S.C. 119(a) of a Korean patent application number 10-2018-0134603, filed on Nov. 5, 2018, in the Korean Intellectual Property Office, the disclosure of which is incorporated by reference herein in its entirety.

BACKGROUND

1. Field

The disclosure relates to a speaker module configured to output a sound by using a diaphragm, and to an electronic device (e.g., a portable communication device) including the speaker module.

2. Description of Related Art

With the increasing use of electronic devices, such as portable terminals (e.g., smartphones), modules that perform various functions have come to be provided in such electronic devices.

For example, an electronic device may include a speaker module in order to output various sounds.

The speaker module may convert an electric signal generated by an electronic device into a sound that can be heard by a user, and thus may output the sound.

The above information is presented as background information only to assist with an understanding of the disclosure. No determination has been made, and no assertion is made, as to whether any of the above might be applicable as prior art with regard to the disclosure.

SUMMARY

In order to smoothly transmit a sound output from the speaker module to the outside of an electronic device, it is required to align a sound hole of the speaker module with a hole (e.g., a speaker hole) disposed in the electronic device.

If the sound hole of the speaker module is not aligned with the hole disposed in the electronic device, a sound in a high-frequency band output from the speaker module may not be smoothly transmitted to the outside of the electronic device.

In order to align a sound hole of the speaker module with a hole disposed in the electronic device, the speaker module may be slantly mounted in an electronic device. However, it may be difficult to slantly mount only the speaker module without changing the arrangement of various products mounted in the electronic device.

Aspects of the disclosure are to address at least the above-mentioned problems and/or disadvantages and to provide at least the advantages described below. Accordingly, an aspect of the disclosure is to provide a speaker module having an inclined diaphragm and an electronic device including the speaker module, so that a sound output through the speaker module can be smoothly transmitted through a hole disposed in the electronic device.

Additional aspects will be set forth in part in the description which follows and, in part, will be apparent from the description, or may be learned by practice of the presented embodiments.

In accordance with an aspect of the disclosure, a speaker module is provided. The speaker module includes a yoke which configures one surface of the speaker module, a magnet which has one surface (e.g., an upper surface, a first surface) arranged on an inner surface of the yoke, a frame which configures a side surface of the speaker module and has a first end portion (e.g., an upper end portion) connected to the yoke, a voice coil spaced apart from the magnet and including at least a portion overlapping the magnet, and a diaphragm which has an inner surface on which the voice coil is arranged. The diaphragm may be connected to a second end portion (e.g., a lower end portion) opposite to the first end portion of the frame and may be inclined to be non-perpendicular to an outer side surface of the frame.

In accordance with another aspect of the disclosure, a speaker module is provided. The speaker module includes a yoke which configures one surface (e.g., a first surface) of the speaker module, a magnet which is arranged on an inner surface of the yoke, a frame which configures a portion of a side surface of the speaker module and has a first end portion (e.g., an upper end portion) connected to the yoke, a protection member which configures another portion of the side surface, and another surface (e.g., a second surface) opposite to the one surface of the speaker module and includes a sound hole surrounded by the another surface of the speaker module, and a diaphragm which is connected to a second end portion (e.g., a lower end portion) opposite to the first end portion (e.g., the upper end portion) of the frame in a first direction and is connected to the protection member in a second direction opposite to the first direction while being inclined to be non-parallel to the another surface (e.g., the second surface) of the speaker module, and a voice coil connected to the diaphragm in the first direction, spaced apart from the magnet, and including at least a portion overlapping the magnet.

In accordance with another aspect of the disclosure, a speaker module is provided. The speaker module includes a yoke which configures one surface of the speaker module, a magnet which has one surface (e.g., an upper surface, a first surface) arranged on an inner surface of the yoke, a frame which is connected to the yoke, has a first region and a second region having different heights and configures a side surface of the speaker module, a voice coil spaced apart from the magnet and including at least a portion overlapping the magnet, and a diaphragm which has an inner surface on which the voice coil is arranged. The diaphragm may be inclined according to a height difference between the first region and the second region.

An electronic device (e.g., a portable communication device) In accordance with another aspect of the disclosure, an electronic device (e.g., a portable communication device) is provided. The electronic device includes a housing which configures at least a portion of a side surface of the electronic device, a touch display which has at least a portion received in the housing and configures at least a portion of one surface of the electronic device, and a speaker module which has at least a portion received in the housing. The speaker module may include a yoke which configures one surface of the speaker module, a magnet which has one surface (e.g., a first surface) arranged on the yoke, a frame which is connected to the yoke and configures a side surface of the speaker module, a voice coil spaced apart from the magnet and including at least a portion overlapping the magnet, and a diaphragm on which the voice coil is arranged and which is connected to the frame while being inclined to be non-perpendicular to an outer side surface of the frame.

In accordance with another aspect of the disclosure, a diaphragm of a speaker is provided. The diaphragm includes module that affects high-frequency band output performance is configured to be inclined in a direction toward a hole (e.g., a speaker hole) disposed in an electronic device, whereby a sound in a high-frequency band output through a speaker module can be smoothly transmitted to the outside of an electronic device.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Figure 1:
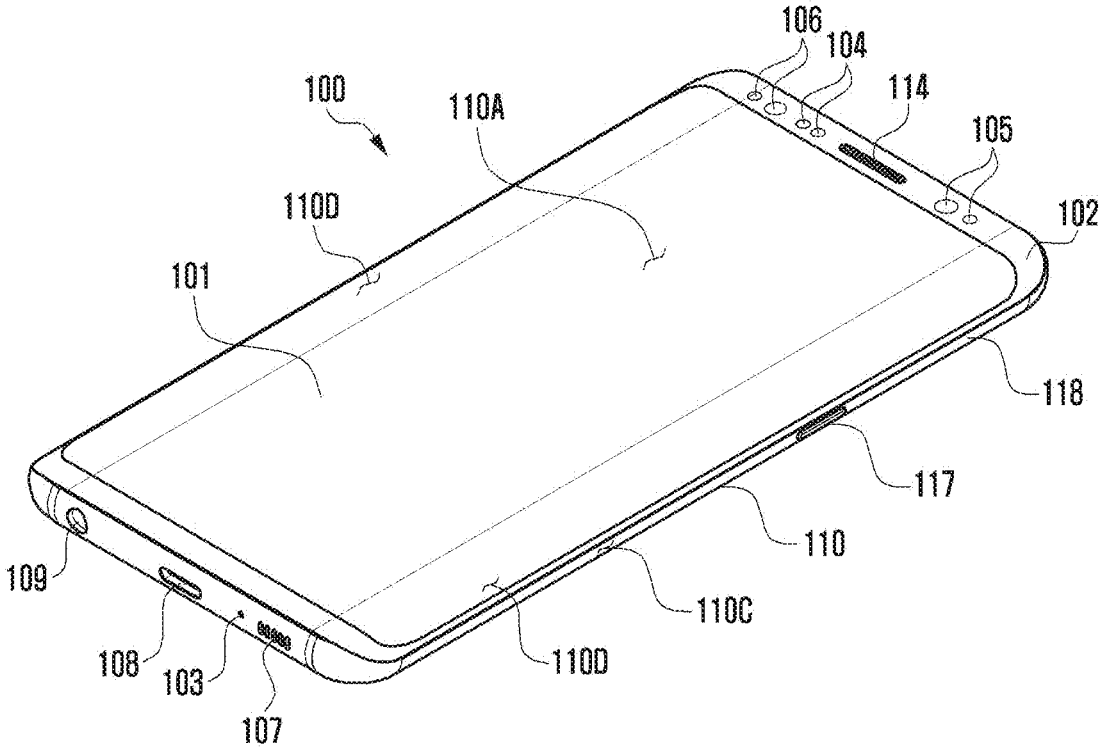
FIG. 1 is a perspective view of a front surface of a mobile electronic device according to an embodiment of the disclosure.

FIG. 1 is a perspective view of the front surface of a mobile electronic device according to an embodiment of the disclosure.

Figure 2:
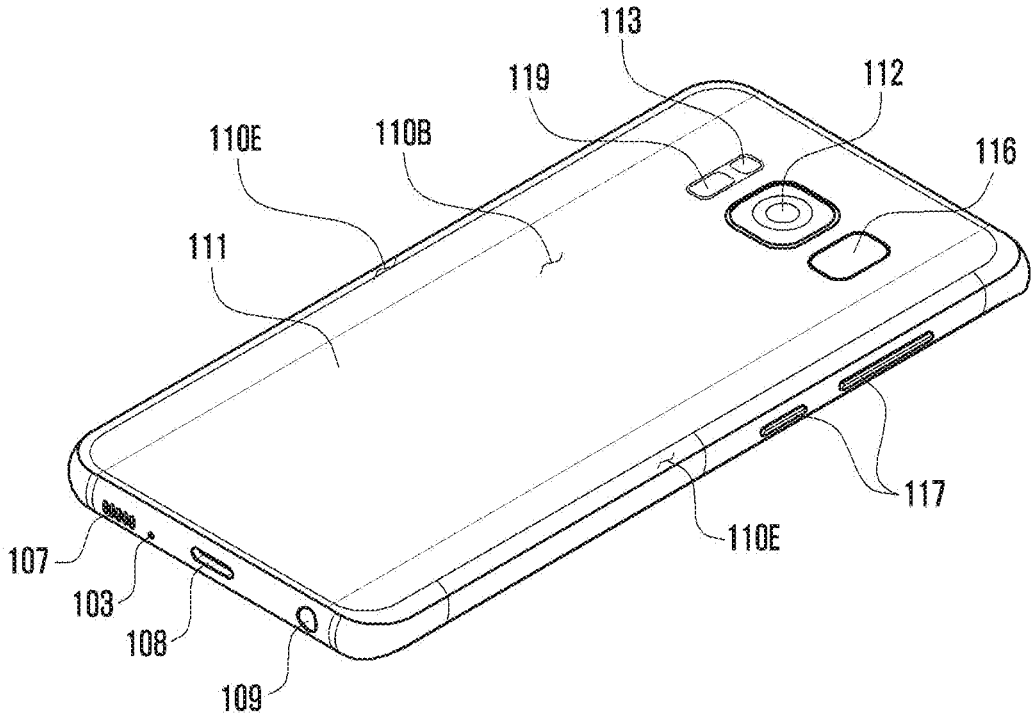
FIG. 2 is a perspective view of the rear surface of the electronic device of FIG. 1 according to an embodiment of the disclosure.

FIG. 2 is a perspective view of the rear surface of the electronic device of FIG. 1 according to an embodiment of the disclosure.

Referring to FIG. 1 and FIG. 2, an electronic device 100 according to an embodiment may include a housing 110 including a first surface (or front surface) 110A, a second surface (or rear surface) 110B, and a side surface 110C surrounding the space between the first surface 110A and the second surface 110B. In another embodiment (not illustrated), the housing may denote a structure that forms a part of the first surface 110A, the second surface 110B, and the side surface 110C illustrated in FIG. 1. According to an embodiment, the first surface 110A may be formed by a front plate 102, at least a part of which is substantially transparent (for example, a glass plate including various coating layers, or a polymer plate). The second surface 110B may be formed by a rear plate 111 that is substantially opaque. The rear plate 111 may be made of coated or colored glass, ceramic, polymer, metal (for example, aluminum, stainless steel (STS), or magnesium), or a combination of at least two of the above-mentioned materials. The side surface 110C may be formed by a side bezel structure (or "side member") 118 which is coupled to the front plate 102 and to the rear plate 111, and which includes metal and/or polymer. In some embodiments, the rear plate 111 and the side bezel structure 118 may be formed integrally and may include the same material (for example, a metal material such as aluminum).

In the illustrated embodiment, the front plate 102 may include two first areas 110D on both ends of the long edge of the front plate 102 such that the two first areas 110D bend from the first surface 110A toward the rear plate 111 and extend seamlessly. In the illustrated embodiment (see FIG. 2), the rear plate 111 may include two second areas 110E on both ends of the long edge such that the two second areas 110E bend from the second surface 110B toward the front plate 102 and extend seamlessly. In some embodiments, the front plate 102 (or the rear plate 111) may include only one of the first areas 110D (or the second areas 110E). In another embodiment, a part of the first areas 110D or the second areas 110E may not be included. In the above embodiments, when seen from the side surface of the electronic device 100, the side bezel structure 118 may have a first thickness (or width) on a part of the side surface, which does not include the first areas 110D or the second areas 110E as described above, and may have a second thickness that is smaller than the first thickness on a part of the side surface, which includes the first areas 110D or the second areas 110E.

According to an embodiment, the electronic device 100 may include at least one of a display 101, audio modules 103, 107, and 114, sensor modules 104, 116, and 119, camera modules 105, 112, and 113, a key input device 117, a light-emitting element 106, and connector holes 108 and 109. In some embodiments, at least one of the constituent elements (for example, the key input device 117 or the light-emitting element 106) of the electronic device 100 may be omitted, or the electronic device 100 may additionally include another constituent element.

The display 101 may be exposed through a corresponding part of the front plate 102, for example. In some embodiments, at least a part of the display 101 may be exposed through the front plate 102 that forms the first areas 110D of the side surface 110C and the first surface 110A. In some embodiments, the display 101 may have a corner formed in substantially the same shape as that of the adjacent outer periphery of the front plate 102. In another embodiment (not illustrated), in order to increase the area of exposure of the display 101, the interval between the outer periphery of the display 101 and the outer periphery of the front plate 102 may be formed to be substantially identical.

In another embodiment (not illustrated), a recess or an opening may be formed in a part of the screen display area of the display 101, and at least one of an audio module 114, a sensor module 104, a camera module 105, and a light-emitting element 106 may be included and aligned with the recess or the opening. In another embodiment (not illustrated), on the back surface of the screen display area of the display 101, at least one of an audio module 114, a sensor module 104, a camera module 105, a fingerprint sensor 116, and a light-emitting element 106 may be included. In another embodiment (not illustrated), the display 101 may be coupled to or arranged adjacent to a touch sensing circuit, a pressure sensor capable of measuring the intensity (pressure) of a touch, and/or a digitizer that detects a magnetic field-type stylus pen. In some embodiments, at least a part of the sensor modules 104 and 119 and/or at least a part of the key input device 117 may be arranged in the first areas 110D and/or the second areas 110E.

The audio modules 103, 107, and 114 may include a microphone hole 103 and speaker holes 107 and 114. A microphone for acquiring an external sound may be arranged in the microphone hole 103, and a plurality of microphones may be arranged therein such that the direction of a sound can be sensed in some embodiments. The speaker holes 107 and 114 may include an outer speaker hole 107 and a speech receiver hole 114. In some embodiments, the speaker holes 107 and 114 and the microphone hole 103 may be implemented as a single hole, or a speaker may be included (for example, a piezoelectric speaker) without the speaker holes 107 and 114.

The sensor modules 104, 116, and 119 may generate an electric signal or a data value corresponding to the internal operating condition of the electronic device 100 or the external environment condition thereof. The sensor modules 104, 116, and 119 may include, for example, a first sensor module 104 (for example, a proximity sensor) arranged on the first surface 110A of the housing 110, and/or a second sensor module (not illustrated) (for example, a fingerprint sensor), and/or a third sensor module 119 (for example, an HRM sensor) arranged on the second surface 110B of the housing 110, and/or a fourth sensor module 116 (for example, a fingerprint sensor). The fingerprint sensor may be arranged not only on the first surface 110A (for example, the display 101) of the housing 110, but also on the second surface 110B thereof. The electronic device 100 may further include a sensor module not illustrated, for example, at least one of a gesture sensor, a gyro sensor, an atmospheric pressure sensor, a magnetic sensor, an acceleration sensor, a grip sensor, a color sensor, an infrared (IR) sensor, a biometric sensor, a temperature sensor, a humidity sensor, or a luminance sensor 104.

The camera modules 105, 112, and 113 may include a first camera device 105 arranged on the first surface 110A of the electronic device 100, a second camera device 112 arranged on the second surface 110B thereof, and/or a flash 113. The camera devices 105 and 112 may include a single lens or a plurality of lenses, an image sensor, and/or an image signal processor. The flash 113 may include, for example, a light-emitting diode or a xenon lamp. In some embodiments, two or more lenses (an infrared camera, a wide-angle lens, and a telephoto lens) and image sensors may be arranged on a single surface of the electronic device 100.

The key input device 117 may be arranged on the side surface 110C of the housing 110. In another embodiment, the electronic device 100 may not include a part of the above-mentioned key input device 117 or the entire key input device 117, and the key input device 117 (not included) may be implemented in another type, such as a soft key, on the display 101. In some embodiments, the key input device may include a sensor module 116 arranged on the second surface 110B of the housing 110.

The light-emitting element 106 may be arranged on the first surface 110A of the housing 110, for example. The light-emitting element 106 may provide information regarding the condition of the electronic device 100 in a light type, for example. In another embodiment, the light-emitting element 106 may provide a light source that interworks with operation of the camera module 105, for example. The light-emitting element 106 may include, for example, a light-emitting diode (LED), an infrared light-emitting diode (IR LED), and a xenon lamp.

The connector holes 108 and 109 may include a first connector hole 108 capable of containing a connector (for example, a universal serial bus (USB) connector) for transmitting/receiving power and/or data to/from an external electronic device, and/or a second connector hole (for example, an earphone jack) 109 capable of containing a connector for transmitting/receiving an audio signal to/from the external electronic device.

Figure 3:
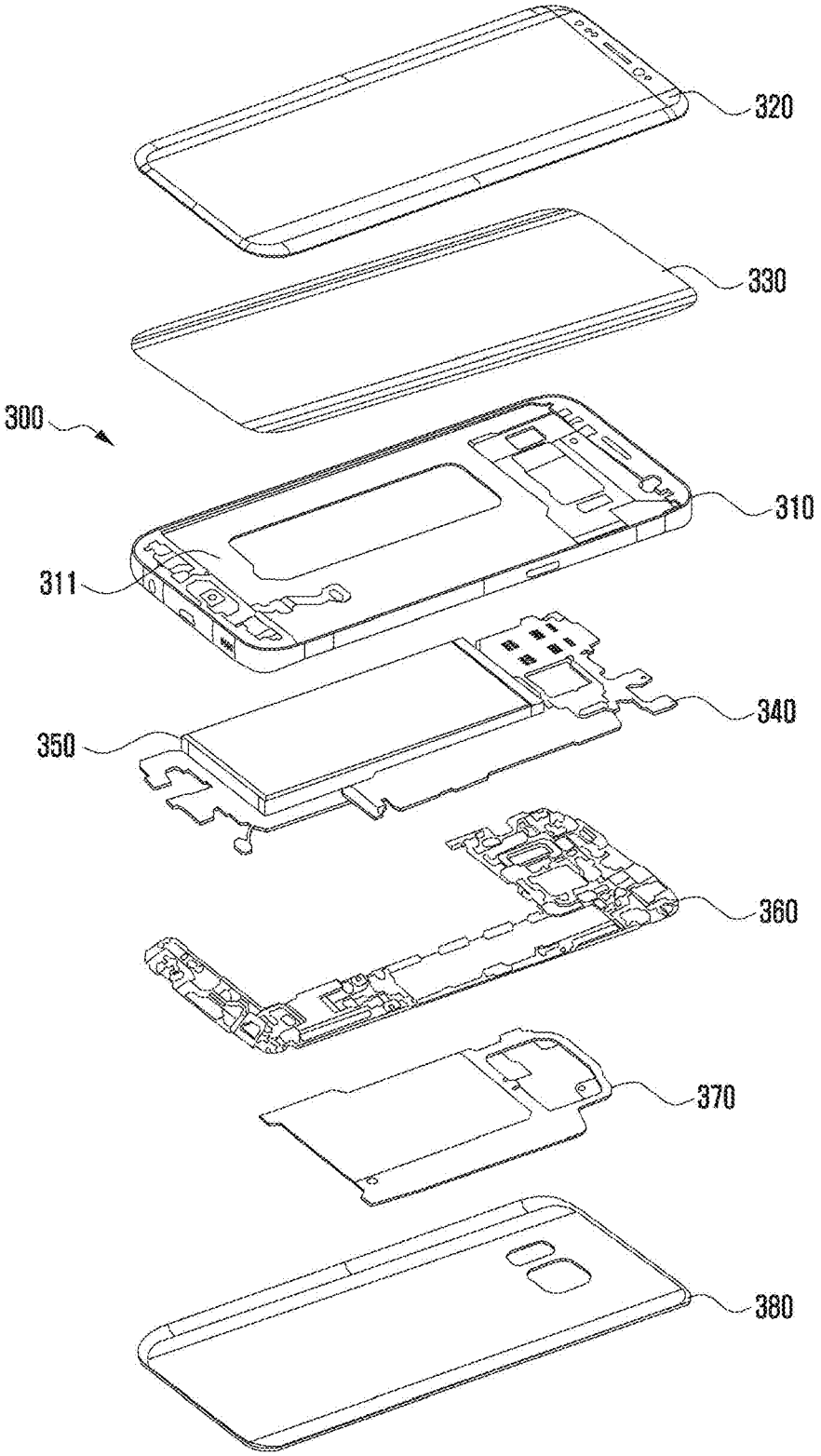
FIG. 3 is a developed perspective view of the electronic device of FIG. 1 according to an embodiment of the disclosure.

FIG. 3 is a developed perspective view of an electronic device of FIG. 1 according to an embodiment of the disclosure.

Referring to FIG. 3, an electronic device 300 may include a side bezel structure 310, a first support member 311 (for example, a bracket), a front plate 320, a display 330, a printed circuit board 340, a battery 350, a second support member 360 (for example, a rear case), an antenna 370, and a rear plate 380. In some embodiments, at least one of the constituent elements (for example, the first support member 311 or the second support member 360) of the electronic device 300 may be omitted, or the electronic device 300 may further include another constituent element. At least one of the constituent elements of the electronic device 300 may be identical or similar to at least one of the constituent elements of the electronic device 100 of FIG. 1 or FIG. 2, and repeated descriptions thereof will be omitted herein.

The first support member 311 may be arranged inside the electronic device 300 and connected to the side bezel structure 310, or may be formed integrally with the side bezel structure 310. The first support member 311 may be made of a metal material and/or a nonmetal (for example, polymer) material, for example. The display 330 may be coupled to one surface of the first support member 311, and the printed circuit board 340 may be coupled to the other surface thereof. A processor, a memory, and/or an interface may be mounted on the printed circuit board 340. The processor may include, for example, one or more of a central processing device, an application processor, a graphic processing device, an image signal processor, a sensor hub processor, or a communication processor.

The memory may include a volatile memory or a non-volatile memory, for example.

The interface may include, for example, a high definition multimedia interface (HDMI), a universal serial bus (USB) interface, a secure digital (SD) card interface, and/or an audio interface. The interface may connect the electronic device 300 with an external electronic device electrically or physically, for example, and may include a USB connector, an SD card/multi-media card (MMC) connector, or an audio connector.

The battery 350 is a device for supplying power to at least one constituent element of the electronic device 300, and may include a non-rechargeable primary cell, a rechargeable secondary cell, or a fuel cell, for example. At least a part of the battery 350 may be arranged on substantially the same plane with the printed circuit board 340, for example. The battery 350 may be arranged integrally inside the electronic device 300, or may be arranged such that the same can be attached to/detached from the electronic device 300.

The antenna 370 may be arranged between the rear plate 380 and the battery 350. The antenna 370 may include, for example, a near field communication (NFC) antenna, a wireless charging antenna, and/or a magnetic secure transmission (MST) antenna. The antenna 370 may conduct near-field communication with an external device or may wirelessly transmit/receive power necessary for charging, for example. In another embodiment, an antenna structure may be formed by a part or a combination of the side bezel structure 310 and/or the first support member 311.

The electronic devices may include at least one of various medical devices (e.g., various portable medical measurement devices (such as blood glucose meters, heart rate monitors, blood pressure monitors, or thermometers, and the like), a magnetic resonance angiography (MRA) device, a magnetic resonance imaging (MRI) device, a computed tomography (CT) device, scanners, or ultrasonic devices, and the like), navigation devices, global positioning system (GPS) receivers, event data recorders (EDRs), flight data recorders (FDRs), vehicle infotainment devices, electronic equipment for vessels (e.g., navigation systems, gyrocompasses, and the like), avionics, security devices, head units for vehicles, industrial or home robots, automatic teller machines (ATMs), points of sales (POSs) devices, or Internet of Things (IoT) devices (e.g., light bulbs, various sensors, electric or gas meters, sprinkler devices, fire alarms, thermostats, street lamps, toasters, exercise equipment, hot water tanks, heaters, boilers, and the like).

The electronic devices may further include at least one of parts of furniture or buildings/structures, electronic boards, electronic signature receiving devices, projectors, or various measuring instruments (such as water meters, electricity meters, gas meters, or wave meters, and the like). The electronic devices may be one or more combinations of the above-mentioned devices. The electronic devices may be flexible electronic devices. Also, the electronic devices are not limited to the above-mentioned devices, and may include new electronic devices according to the development of new technologies.

Embodiments of the disclosure will be described herein below with reference to the accompanying drawings. However, the embodiments of the disclosure are not limited to the specific embodiments and should be construed as including all modifications, changes, equivalent devices and methods, and/or alternative embodiments of the disclosure.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the disclosure, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The term "module" as used herein may be defined as, for example, a unit including one of hardware, software, and firmware or two or more combinations thereof. The term "module" may be interchangeably used with, for example, the terms "unit", "logic", "logical block", "component", or "circuit", and the like. The "module" may be a minimum unit of an integrated component or a part thereof. The "module" may be a minimum unit performing one or more functions or a part thereof.

Figure 4:
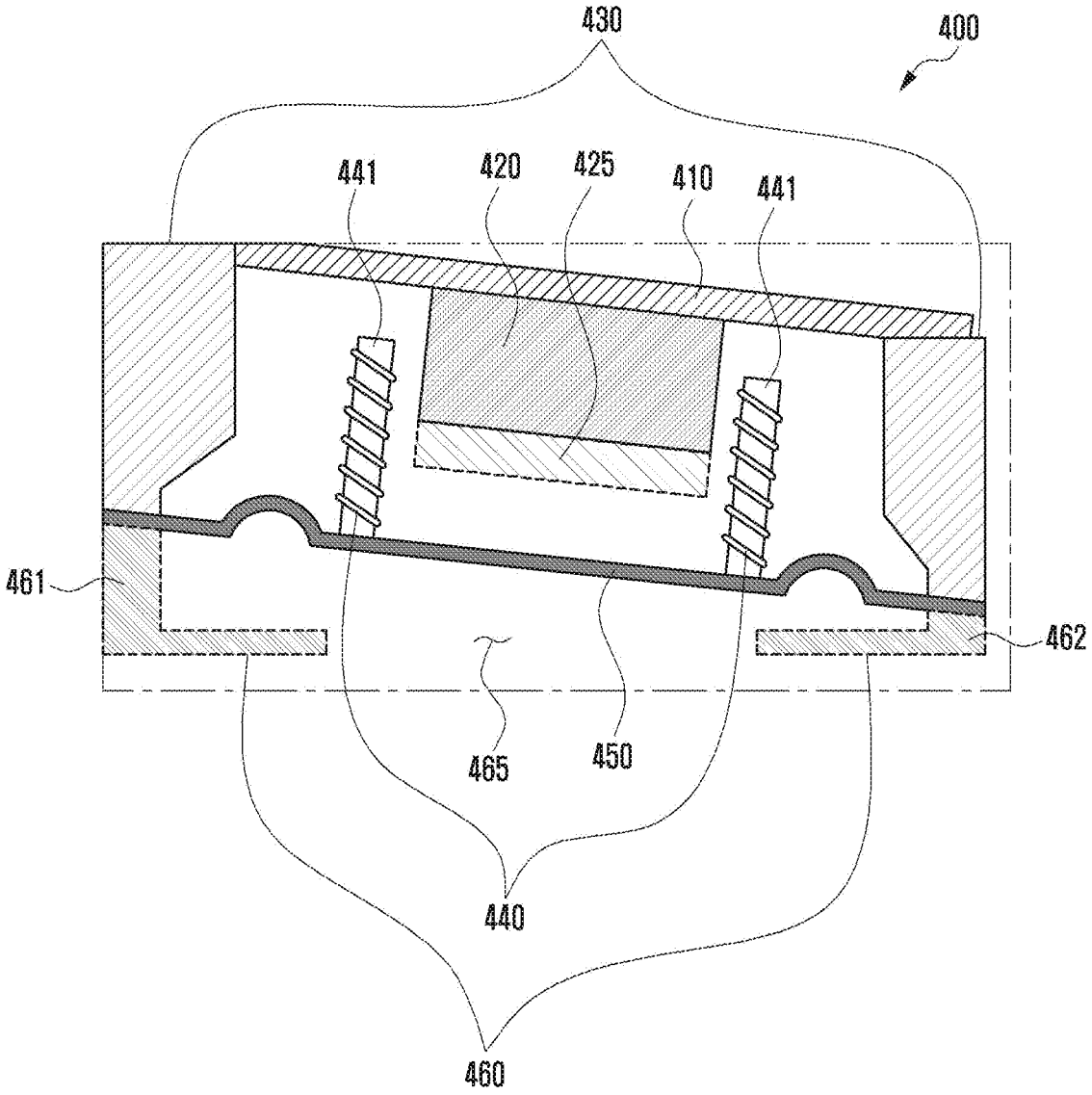
FIG. 4 is a cross-sectional view of an example, schematically illustrating a configuration of a speaker module according to an embodiment of the disclosure.

FIG. 4 is a cross-sectional view of an example, schematically illustrating a configuration of a speaker module according to an embodiment of the disclosure.

Referring to FIG. 4, a speaker module 400 according to various embodiments may include a yoke 410, a magnet 420, a frame 430, voice coils 440, and a diaphragm 450.

According to various embodiments, the yoke 410 may configure one surface (e.g., an upper surface, a first surface)

of the speaker module 400. The yoke 410 may fix the magnet 420. The yoke 410 may be made of a material having a high magnetic conductivity (e.g., SUS430, SUS304, or SPCC).

According to various embodiments, the magnet 420 may be arranged such that one surface thereof (e.g., an upper surface, a first surface) is mounted on the yoke 410. The magnet 420 may be mounted on the yoke 410 to form a magnetic field. The magnet 420 may include, for example, a neodymium magnet or an alnico magnet. The magnet 420 may cause the voice coils 440 to vibrate up and down according to Fleming's left-hand rule.

According to one embodiment, a plate 425 may be arranged on another surface (e.g., a lower surface, a second surface) opposite to the one surface (e.g., the upper surface) of the magnet 420. The plate 425 may perform a function of collecting a magnetic field generated by the magnet 420. The plate 425 may be made of a material (e.g., SUS430, SUS304, or SPCC) having a high magnetic conductivity. The plate 425 may constitute a magnetic circuit of the speaker module 400 together with the yoke 410 and the magnet 420. For example, the magnetic flux generated in the magnet 420 may form a path of a magnetic flux coming to the yoke 410 through the plate 425.

According to various embodiments, one end portion (e.g., an upper end portion) of the frame 430 may be connected (or coupled) to the yoke 410. The frame 430 may configure a side surface of the speaker module 400. The frame 430 may configure an outer appearance of the speaker module 400. The frame 430 may be made of, for example, plastic.

According to various embodiments, each of the voice coils 440 may be spaced apart from the magnet 420 and may have at least a portion overlapping the magnet. According to one embodiment, the voice coil 440 may be configured to substantially surround at least a portion of the magnet 420 and the plate 425. The voice coil 440 may be configured by a wire wound on at least one axis 441 arranged on an inner surface of the diaphragm 450. The voice coil 440 may vibrate through interaction with the magnet 420 by an electric signal applied from the outside and may thus vibrate the diaphragm 450.

According to various embodiments, the diaphragm 450 may be connected to the voice coil 440. For example, the voice coil 440 may be mounted on the inner surface of the diaphragm 450. The diaphragm 450 may be connected to another end portion (e.g., a lower end portion) opposite to the one end portion of the frame 430 and may be inclined to be non-perpendicular to an outer side surface of the frame 430. The diaphragm 450 may be configured to be inclined in a direction of a speaker hole (e.g., speaker holes 107 and 114 in FIG. 1) of an electronic device (e.g., an electronic device 100 in FIG. 1). The diaphragm 450 may generate a sound by vibrating together with the voice coil 440. According to one embodiment, the diaphragm 450 may include a thin film. For example, the diaphragm 450 may be formed of various materials including a thin film material, such as polyether ether ketone (PEEK) and polyetherimide (PEI), having thermoplastic properties, and silicon, graphene, carbon, and metal materials.

According to various embodiments, a protection member 460 may be arranged opposite to the yoke 410 which configures one surface (e.g., an upper surface, a first surface) of the speaker module 400. For example, the protection member 460 may be arranged on an outer surface of the diaphragm 450. The protection member 460 may have at least an open portion to form a sound hole 465. According to one embodiment, the size of the sound hole 465 may be adjusted. For example, the sound hole 465 may have a size that does not cause generation of a touch with respect to a driving region of the diaphragm 450. According to embodiment, the protection member 460 may include a first region 461 and a second region 462. The first region 461 may have a first height. The second region 462 may have a second height. The first height may be higher than the second height.

According to one embodiment, the yoke 410 may be arranged parallel to the inclined diaphragm 450. The yoke 410 may be connected to one end portion (e.g., an upper end portion) of the frame 430 to be non-perpendicular to an outer side surface of the frame 430.

According to one embodiment, the magnet 420 may have another surface (e.g., a lower surface) arranged parallel to the inclined diaphragm 450.

According to one embodiment, the magnet 420 and the voice coil 440, which affect vibration of the diaphragm 450, may be inclined together as the diaphragm 450 is inclined.

Figure 5:
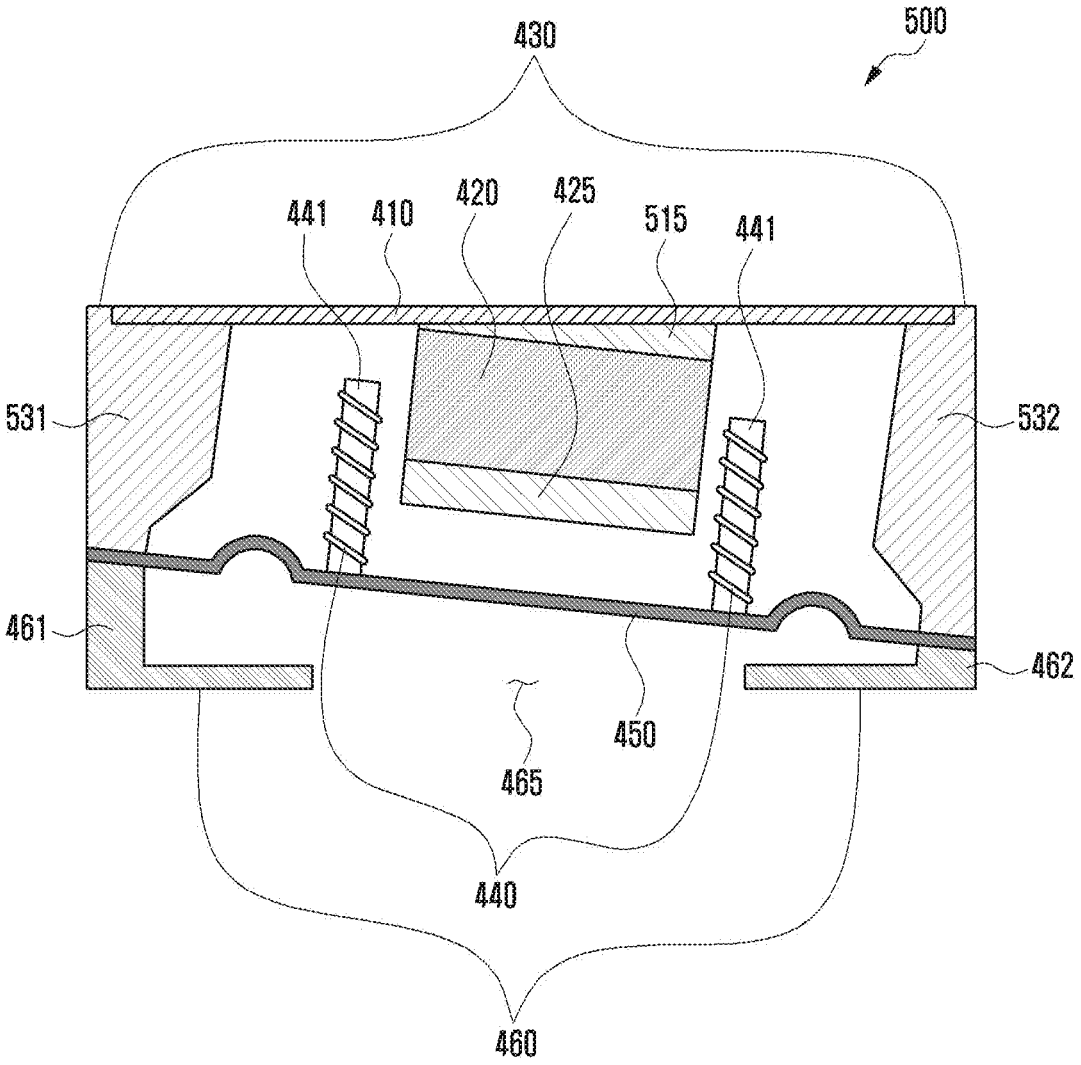
FIG. 5 is a cross-sectional view of another example, schematically illustrating a configuration of a speaker module according to an embodiment of the disclosure.

FIG. 5 is a cross-sectional view of another example, schematically illustrating a configuration of a speaker module according to an embodiment of the disclosure.

In the description of FIG. 5, the same structures and functions as those of FIG. 4, described above, will not be described again.

Referring to FIG. 5, a speaker module 500 according to various embodiments may include the yoke 410, a first connection member 515, the magnet 420, the frame 430, the voice coils 440, and the diaphragm 450.

According to various embodiments, the yoke 410 may configure one surface (e.g., an upper surface, a first surface) of the speaker module 500. The yoke 410 may be mounted inside the frame 430.

According to various embodiments, the magnet 420 may be arranged such that one surface thereof (e.g., an upper surface, a first surface) is mounted on the yoke 410.

According to various embodiments, the speaker module 500 in FIG. 5 may further include a first connection member 515, unlike the speaker module 400 in FIG. 4. The first connection member 515 may be arranged between one surface of the magnet 420 and the yoke 410 so that the one surface (e.g., the upper surface, the first surface) of the magnet 420 is inclined with respect to the yoke 410.

According to one embodiment, the plate 425 may be mounted on another surface (e.g., a lower surface, a second surface) opposite to the one surface (e.g., the upper surface) of the magnet 420.

According to various embodiments, one end portion (e.g., an upper end portion) of the frame 430 may be connected to the yoke 410. The frame 430 may configure a side surface of the speaker module 500. The frame 430 may have a first region 531 and a second region 532 having different heights. According to one embodiment, the height of the first region 531 of the frame 430 may be lower than that of the second region 532.

According to various embodiments, each of the voice coils 440 may be spaced apart from the magnet 420 and may have at least a portion overlapping the magnet. According to one embodiment, the voice coil 440 may be configured to substantially surround at least a portion of the magnet 420, and the plate 425.

According to various embodiments, the diaphragm 450 may be connected to the voice coil 440. The diaphragm 450 may be connected to the frame 430 while being inclined according to a height difference between the first region 531 and the second region 532 of the frame 430.

According to various embodiments, the protection member 460 may be arranged opposite to the yoke 410 configuring one surface of the speaker module 500. For example, the protection member 460 may be arranged on an outer surface of the diaphragm 450. The protection member 460 may have at least an open portion to form a sound hole 465. According to one embodiment, the protection member 460 may include a first region 461 and a second region 462. The first region 461 may have a first height. The second region 462 may have a second height. The first height may be higher than the second height.

According to one embodiment, the yoke 410 may be arranged to be non-parallel to the inclined diaphragm 450. The yoke 410 may be connected to one end portion of the frame 430 so as to be perpendicular to an outer side surface of the frame 430.

According to one embodiment, the magnet 420 may have another surface (e.g. a lower surface, a second surface) arranged parallel to the inclined diaphragm 450. The magnet 420 may have a side surface arranged to be non-parallel to an outer side surface of the frame 430.

Figure 6:
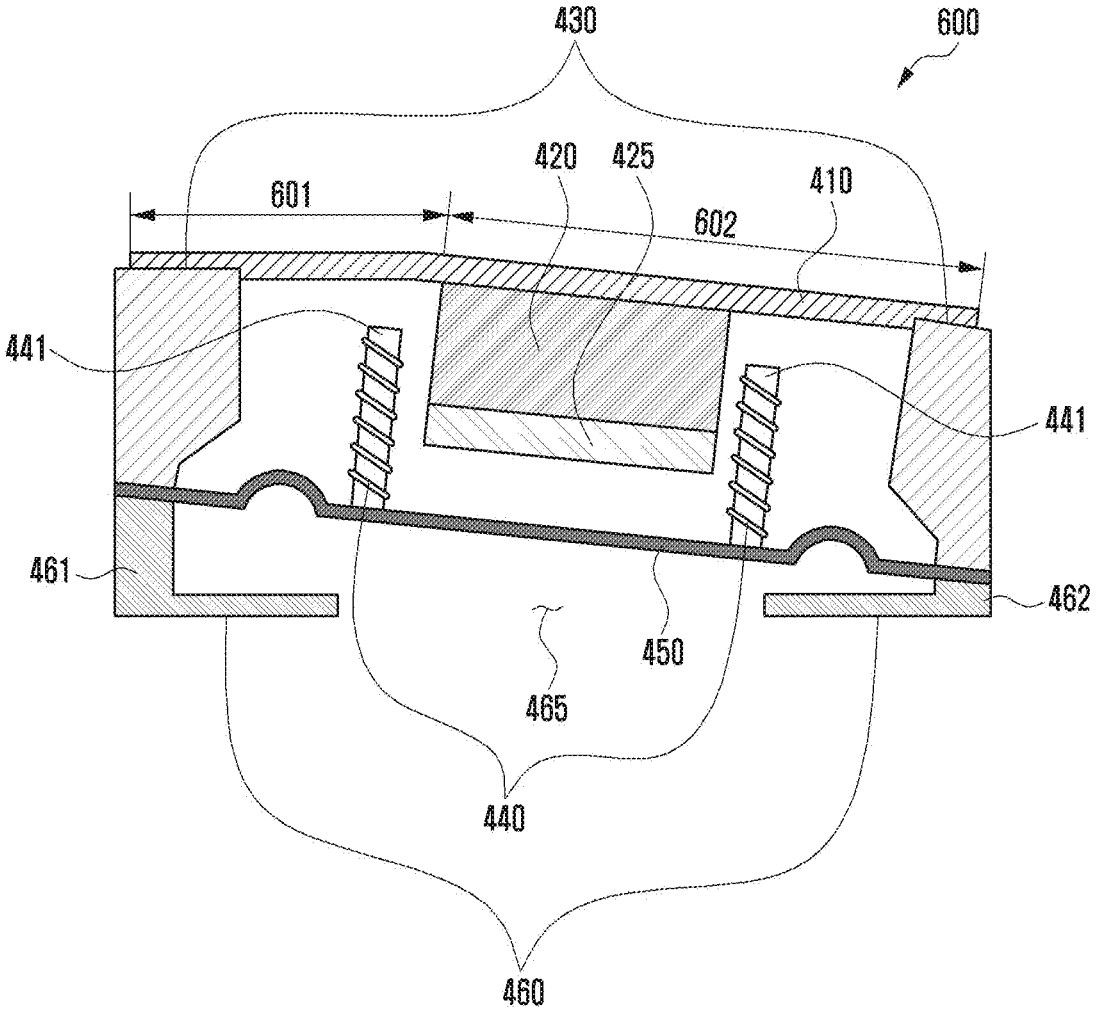
FIG. 6 is a cross-sectional view of another example, schematically illustrating a configuration of a speaker module according to an embodiment of the disclosure.

FIG. 6 is a cross-sectional view of another example, schematically illustrating a configuration of a speaker module according to an embodiment of the disclosure.

In the description of FIG. 6, the same structures and functions as those of FIGS. 4 and 5, described above, will not be described again.

Referring to FIG. 6, a speaker module 600 according to various embodiments may include the yoke 410, the magnet 420, the frame 430, the voice coils 440, and the diaphragm 450.

According to various embodiments, the yoke 410 may configure one surface (e.g., an upper surface, a first surface) of the speaker module 600.

According to various embodiments, the speaker module 600 in FIG. 6 may be configured such that at least a portion of the yoke 410 is bent, unlike the speaker module 400 in FIG. 4 and the speaker module 500 in FIG. 5. The yoke 410 may be bent at a predetermined position to form a first region 601 and a second region 602. According to various embodiments, the magnet 420 may be arranged such that one surface thereof (e.g., an upper surface) is mounted on the second region 602 of the yoke 410.

According to one embodiment, the plate 425 may be arranged on another surface (e.g., a lower surface, a second surface) opposite to the one surface of the magnet 420.

According to various embodiments, one end portion (e.g., an upper end portion) of the frame 430 may be connected (or coupled) to the yoke 410.

According to various embodiments, each of the voice coils 440 may be spaced apart from the magnet 420 and may have at least a portion overlapping the magnet. According to one embodiment, the voice coil 440 may be configured to substantially surround at least a portion of the magnet 420, and the plate 425.

According to various embodiments, the diaphragm 450 may be connected to the voice coil 440. The diaphragm 450 may be arranged to be non-perpendicular to an outer side surface of the frame 430.

According to various embodiments, the protection member 460 may be arranged opposite to the yoke 410 which configures one surface of the speaker module 600. For example, the protection member 460 may be arranged on an outer surface of the diaphragm 450. The protection member 460 may have at least an open portion to form a sound hole 465.

According to one embodiment, the first region 601 of the yoke 410 may be arranged to be non-parallel to the inclined diaphragm 450. The second region 602 of the yoke 410 may be arranged parallel to the inclined diaphragm 450.

Figure 7:
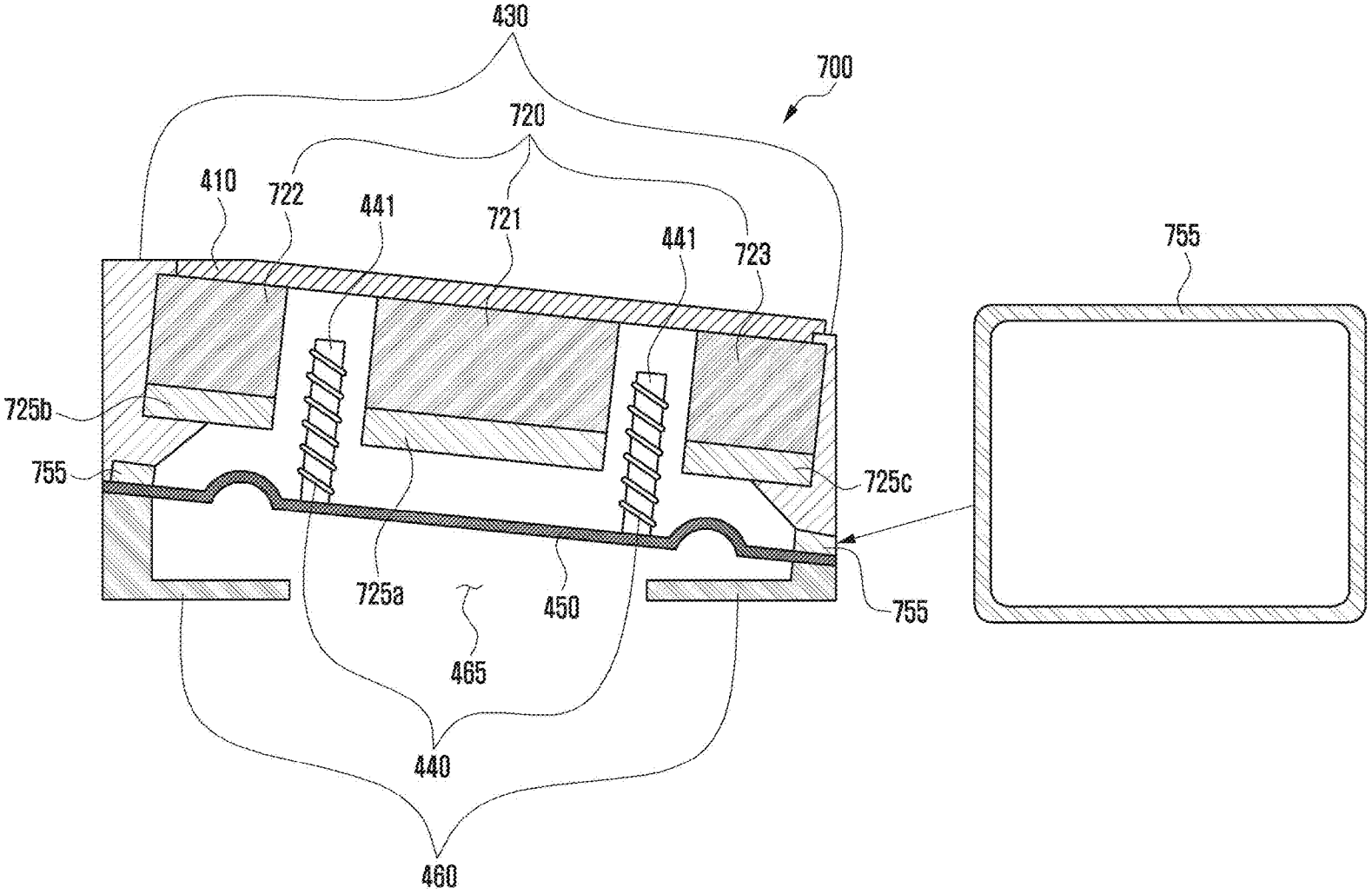
FIG. 7 is a cross-sectional view of another example, schematically illustrating a configuration of a speaker module according to an embodiment of the disclosure.

FIG. 7 is a cross-sectional view of another example, schematically illustrating a configuration of a speaker module according to an embodiment of the disclosure.

In the description of FIG. 7, the same structures and functions as those of FIGS. 4 to 6, described above, will not be described again.

Referring to FIG. 7, a speaker module 700 according to various embodiments may include the yoke 410, a magnet 720, the frame 430, the voice coils 440, the diaphragm 450, and a mounting ring 755.

According to various embodiments, the yoke 410 may configure one surface (e.g., an upper surface, a first surface) of the speaker module 700. The yoke 410 may be arranged parallel to the inclined diaphragm 450. The yoke 410 may be connected to one end portion (e.g., an upper end portion) of the frame 430 so as to be non-perpendicular to an outer side surface of the frame 430.

According to various embodiments, the speaker module 700 in FIG. 7 may include a magnet 720 which is different from those of the speaker module 400 in FIG. 4, the speaker module 500 in FIG. 5, and the speaker module 600 in FIG. 6. The magnet 720 may be divided into one or more magnets (e.g., a first magnet 721, a second magnet 722, and a third magnet 723).

According to one embodiment, a first plate 725*a*, a second plate 725*b*, and a third plate 725*c* may be mounted to ends (e.g., lower ends) of the first magnet 721, the second magnet 722, and the third magnet 723, respectively.

According to various embodiments, one end portion (e.g., an upper end portion) of the frame 430 may be connected to the yoke 410.

According to various embodiments, the voice coils 440 may be arranged between the first magnet 721 and the second magnet 722 and between the first magnet 721 and the third magnet 723 while being spaced apart from the first magnet 721, the second magnet 722, and the third magnet 723.

According to various embodiments, the diaphragm 450 may be connected to the voice coils 440. The diaphragm 450 may be connected to another end portion (e.g., a lower end portion) opposite to the one end portion of the frame 430 and may be inclined to be non-perpendicular to an outer side surface of the frame 430.

According to various embodiments, the speaker module 700 in FIG. 7 may further include a mounting ring 755, unlike the speaker module 400 in FIG. 4, the speaker module 500 in FIG. 5, and the speaker module 600 in FIG. 6. The mounting ring 755 may be arranged between the other end portion (e.g., the lower end portion) of the frame 430 and the diaphragm 450. When the speaker module 700 is assembled, the diaphragm 450 may be first attached to the mounting ring 755. If the diaphragm 450 is first attached to the mounting ring 755, the diaphragm 450 may be prevented from being misaligned or being further inclined at the time of assembly of other elements (e.g., the magnet 720, the voice coils 440, etc.).

According to various embodiments, the protection member 460 may be arranged opposite to the yoke 410 which configures one surface of the speaker module 700. For example, the protection member 460 may be arranged on outer surface of the diaphragm 450. The protection member 460 may have at least an open portion to form a sound hole 465.

Figure 8:
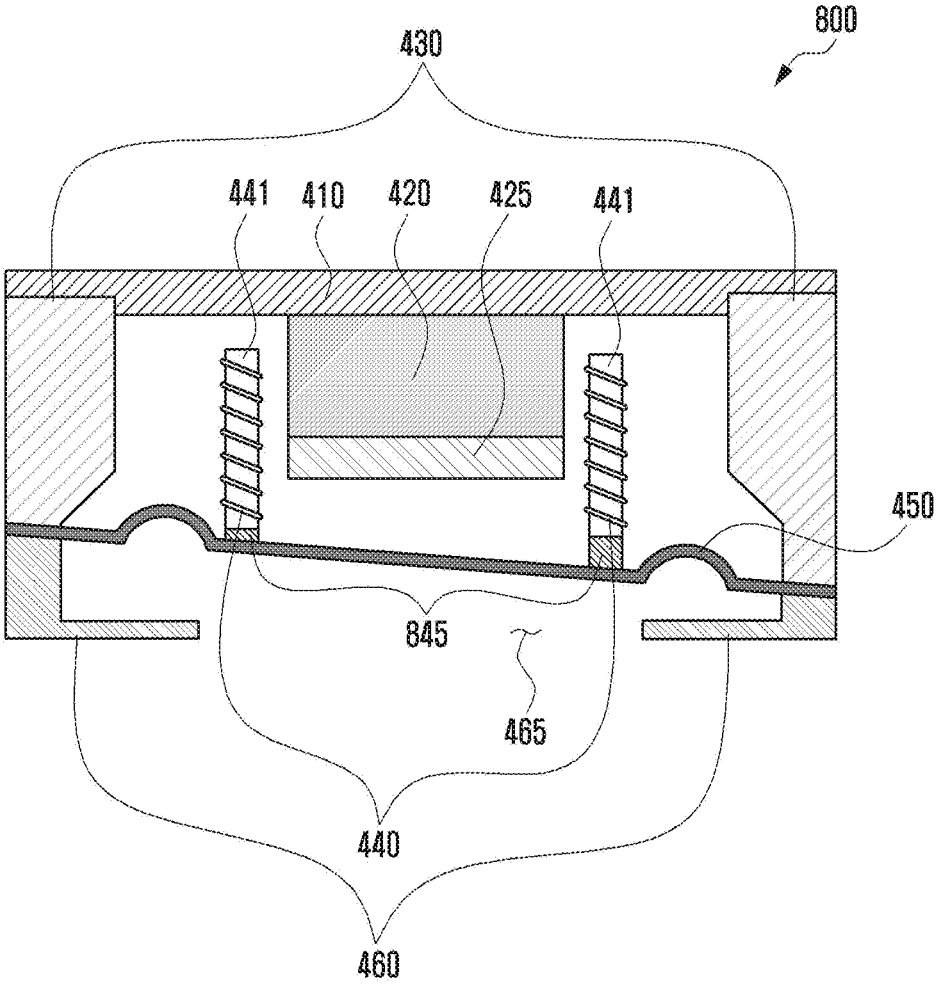
FIG. 8 is a cross-sectional view of another example, schematically illustrating a configuration of a speaker module according to an embodiment of the disclosure.

FIG. 8 is a cross-sectional view of another example, schematically illustrating a configuration of a speaker module according to an embodiment of the disclosure.

In the description of FIG. 8, the same structures and functions as those of FIGS. 4 to 7, described above, will not be described again.

Referring to FIG. 8, a speaker module 800 according to various embodiments may include the yoke 410, the magnet 420, the frame 430, the voice coils 440, the diaphragm 450, and second connection members 845.

According to various embodiments, the yoke 410 may configure one surface (e.g., an upper surface, a first surface) of the speaker module 800. The yoke 410 may be arranged to be non-parallel to the inclined diaphragm 450. The yoke 410 may be connected to one end portion of the frame 430 so as to be perpendicular to an outer side surface of the frame 430.

According to various embodiments, the magnet 420 may be arranged such that one surface thereof (e.g., an upper surface, a first surface) is mounted on the yoke 410.

According to one embodiment, the plate 425 may be mounted on another surface (e.g., a lower surface, a second surface) opposite to the one surface (e.g., the upper surface) of the magnet 420.

According to various embodiments, one end portion (e.g., an upper end portion) of the frame 430 may be connected to the yoke 410.

According to various embodiments, each of the voice coils 440 may be spaced apart from the magnet 420 and may have at least a portion overlapping the magnet. According to one embodiment, the voice coil 440 may be configured to substantially surround at least a portion of the magnet 420, and the plate 425.

According to various embodiments, the diaphragm 450 may be connected to the voice coil 440.

According to various embodiments, the speaker module 800 in FIG. 8 may further include the second connection members 845, unlike the speaker module 400 in FIG. 4, the speaker module 500 in FIG. 5, the speaker module 600 in FIG. 6, and the speaker module 700 in FIG. 7. Each of the second connection members 845 may be arranged between the voice coil 440 and the diaphragm 450 so that the voice coil 440 has a side surface parallel to an outer side surface of the frame 430. The voice coil 440 arranged on the second connection member 845 may be arranged to be non-perpendicular to the diaphragm 450.

According to various embodiments, the protection member 460 may be arranged opposite to the yoke 410 which configures one surface of the speaker module 800. For example, the protection member 460 may be arranged on an outer surface of the diaphragm 450. The protection member 460 may have at least an open portion to form a sound hole 465.

Figure 9:
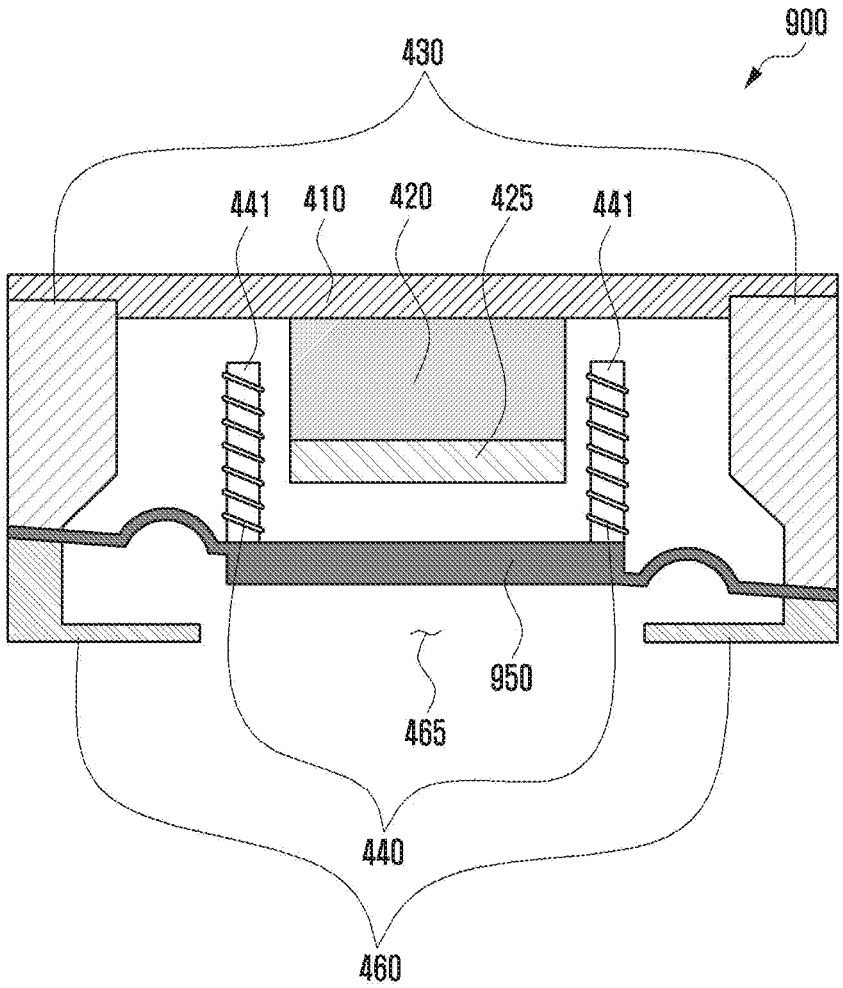
FIG. 9 is a cross-sectional view of another example, schematically illustrating a configuration of a speaker module according to an embodiment of the disclosure.

FIG. 9 is a cross-sectional view of another example, schematically illustrating a configuration of a speaker module according to an embodiment of the disclosure.

In the description of FIG. 9, the same structures and functions as those of FIGS. 4 to 8, described above, will not be described again.

Referring to FIG. 9, a speaker module 900 according to various embodiments may include the yoke 410, the magnet 420, the frame 430, the voice coils 440, and a diaphragm 950.

According to various embodiments, the yoke 410 may configure one surface (e.g., an upper surface, a first surface) of the speaker module 900.

According to various embodiments, the magnet 420 may be arranged such that one surface thereof (e.g., an upper surface, a first surface) is mounted on the yoke 410.

According to one embodiment, the plate 425 may be mounted on another surface (e.g., a lower surface, a second surface) opposite to the one surface (e.g., the upper surface) of the magnet 420.

According to various embodiments, one end portion (e.g., an upper end portion) of the frame 430 may be connected to the yoke 410.

According to various embodiments, each of the voice coils 440 may be spaced apart from the magnet 420 and may have at least a portion overlapping the magnet. According to one embodiment, the voice coil 440 may be configured to substantially surround at least a portion of the magnet 420, and the plate 425.

According to various embodiments, the speaker module 900 in FIG. 9 may include a diaphragm 950, which is different from those of the speaker module 400 in FIG. 4, the speaker module 500 in FIG. 5, the speaker module 600 in FIG. 6, the speaker module 700 in FIG. 7, and the speaker module 800 in FIG. 8. The diaphragm 950 may include a high-band dome which is thick and is disposed on at least a partial region (e.g., a center portion) thereof. The diaphragm 950 may be connected to the voice coil 440.

According to various embodiments, the protection member 460 may be arranged opposite to the yoke 410 which configures one surface of the speaker module 900. For example, the protection member 460 may be arranged on an outer surface of the diaphragm 950. The protection member 460 may have at least an open portion to form a sound hole 465.

Figure 10:
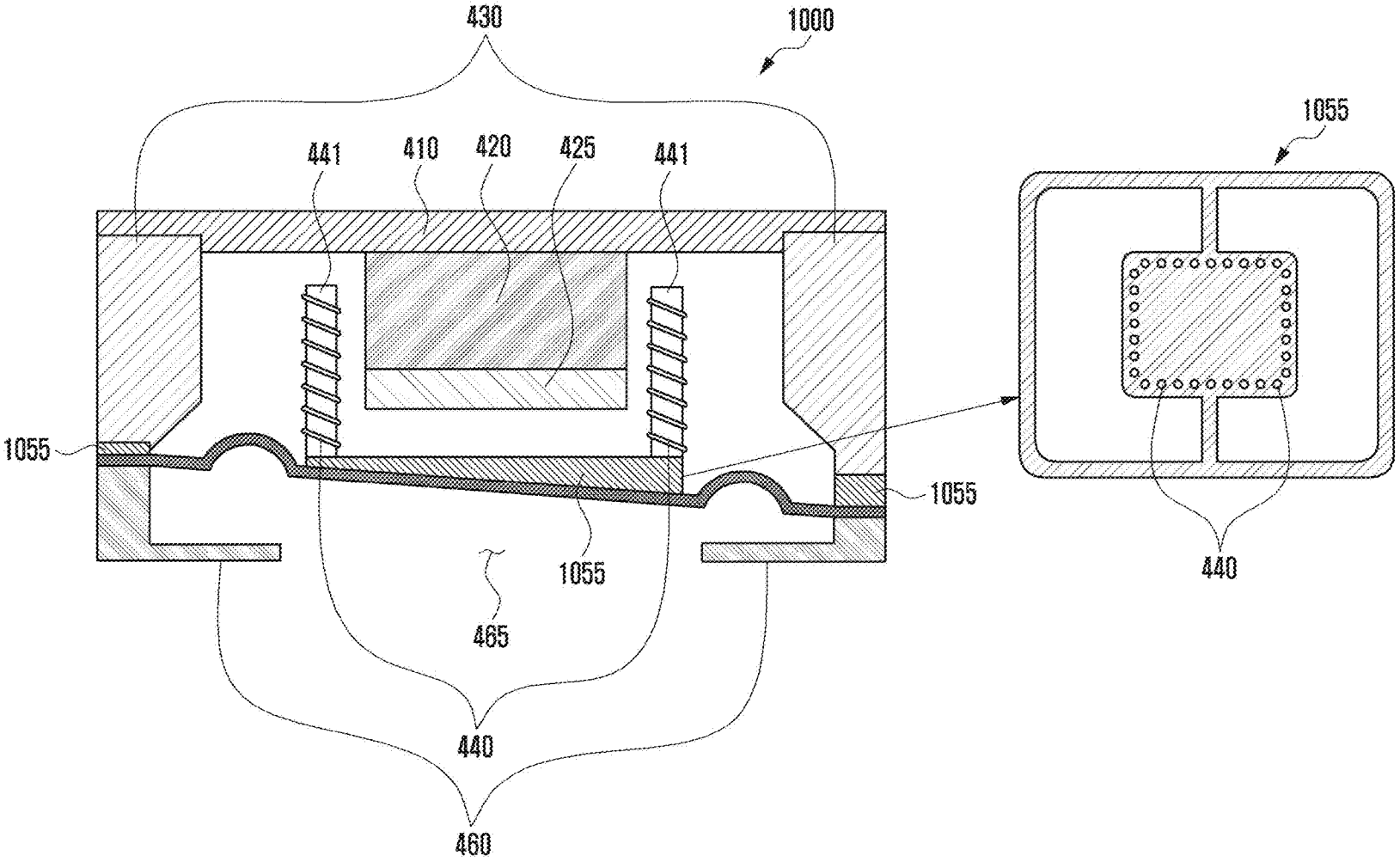
FIG. 10 is a cross-sectional view of another example, schematically illustrating a configuration of a speaker module according to an embodiment of the disclosure.

FIG. 10 is a cross-sectional view of another example, schematically illustrating a configuration of a speaker module according to an embodiment of the disclosure.

In the description of FIG. 10, the same structures and functions as those of FIGS. 4 to 9, described above, will not be described again.

Referring to FIG. 10, a speaker module 1000 according to various embodiments may include the yoke 410, the magnet 420, the frame 430, the voice coils 440, a fixing ring 1055, and the diaphragm 450.

According to various embodiments, the yoke 410 may configure one surface (e.g., an upper surface, a first surface) of the speaker module 1000. The yoke 410 may be arranged to be non-parallel to the inclined diaphragm 450. The yoke 410 may be connected to one end portion of the frame 430 so as to be perpendicular to an outer side surface of the frame 430.

According to various embodiments, the magnet 420 may be arranged such that one surface (e.g., an upper surface, a first surface) is mounted one the yoke 410.

According to one embodiment, the plate 425 may be mounted on another surface (e.g., a lower surface, a second surface) opposite to the one surface (e.g., the upper surface) of the magnet 420.

According to various embodiments, one end portion (e.g., an upper end portion) of the frame 430 may be connected to the yoke 410.

According to various embodiments, each of the voice coils 440 may be spaced apart from the magnet 420 and may have at least a portion overlapping the magnet. According to one embodiment, the voice coil 440 may be configured to substantially surround at least a portion of the magnet 420, and the plate 425.

According to various embodiments, the speaker module 1000 in FIG. 10 may further include a fixing ring 1055, unlike the speaker module 400 in FIG. 4, the speaker module 500 in FIG. 5, the speaker module 600 in FIG. 6, the speaker module 700 in FIG. 7, the speaker module 800 in FIG. 8, and the speaker module 900 in FIG. 9. The fixing ring 1055 may be arranged at the bottom of the voice coil 440 and at another end portion (e.g., a lower end portion) opposite to the one end portion of the frame 430. The fixing ring 1055 may be arranged between the voice coil 440 and the diaphragm 450. When the speaker module 1000 is assembled, the voice coil 440 and the diaphragm 450 may be attached to the fixing ring 1055. If the voice coil 440 and the diaphragm 450 are attached to the fixing ring 1055, misalignment of the voice coil 440 or further inclination of the diaphragm 450 may be prevented at the time of assembly of other elements (e.g., the magnet 420, etc.).

According to various embodiments, the diaphragm 450 may be arranged at the bottom of the fixing ring 1055. The diaphragm 450 may be connected to another end portion (e.g., a lower end portion) opposite to the one end portion of the frame 430, and may be inclined to be non-perpendicular to an outer side surface of the frame 430.

According to various embodiments, the protection member 460 may be arranged opposite to the yoke 410 which configures one surface of the speaker module 1000. For example, the protection member 460 may be arranged on an outer surface of the diaphragm 450. The protection member 460 may have at least an open portion to form a sound hole 465.

Figure 11:
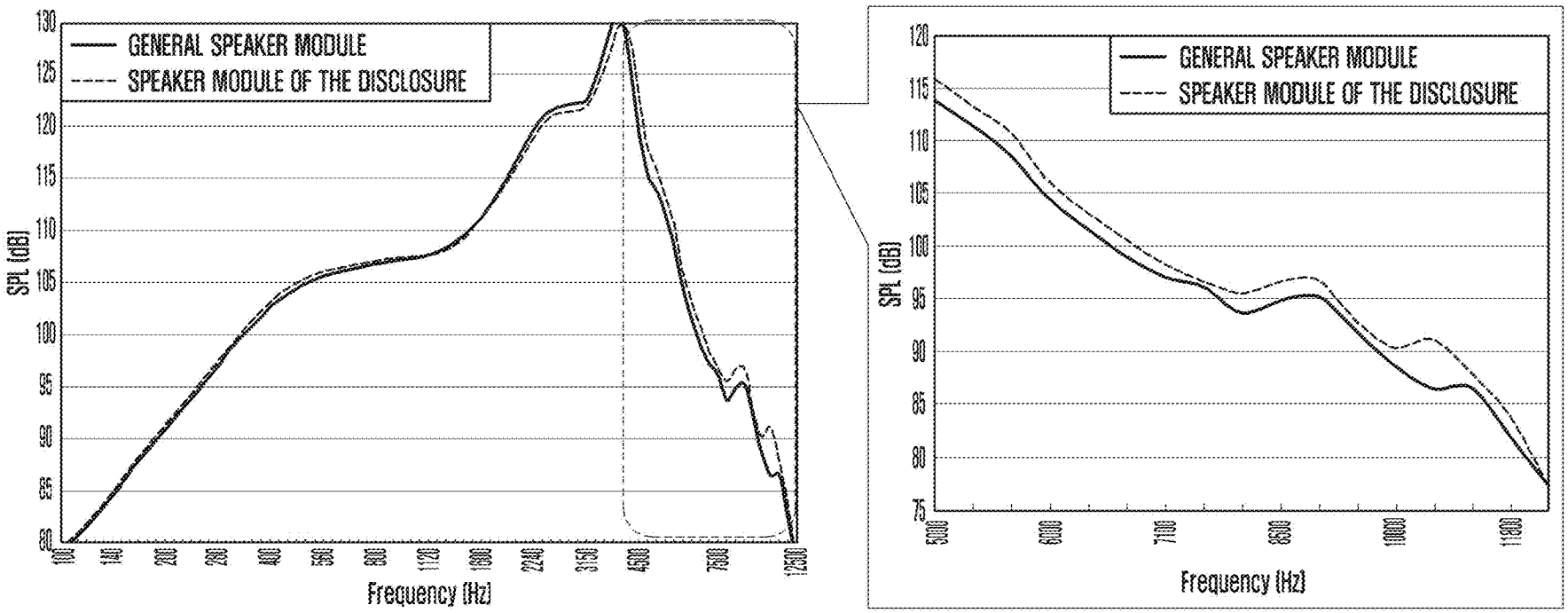
FIG. 11 is a graph of an example comparing sound performance of an electronic device including a speaker module with that of an electronic device including a general speaker module according to an embodiment of the disclosure.

FIG. 11 is a graph of an example comparing the sound performance of an electronic device including a speaker module according to various embodiments with that of an electronic device including a general speaker module according to an embodiment of the disclosure.

FIG. 11 shows the sound performance of an electronic device including a speaker module having the inclined diaphragm 450 according to various embodiments and that of an electronic device including a general speaker module, measured in a handset mode in which a phone call is made using electronic device held in the hand.

Referring to FIG. 11, the output sound pressure level (SPL (dB)) and frequency (Hz) of an electronic device including a general speaker module were measured, and are indicated by a solid line, while the output sound pressure level and frequency of an electronic device including a speaker module having the inclined diaphragm 450 according to various embodiments were measured, and are indicated by a dotted line.

As noted from FIG. 11, it can be seen that, in a handset mode in which a phone call is made using an electronic device held in the hand, an electronic device including a speaker module having the inclined diaphragm 450 according to various embodiments has output sound pressure level and high-frequency band superior to those of an electronic device including a non-inclined general speaker module.

Figure 12:
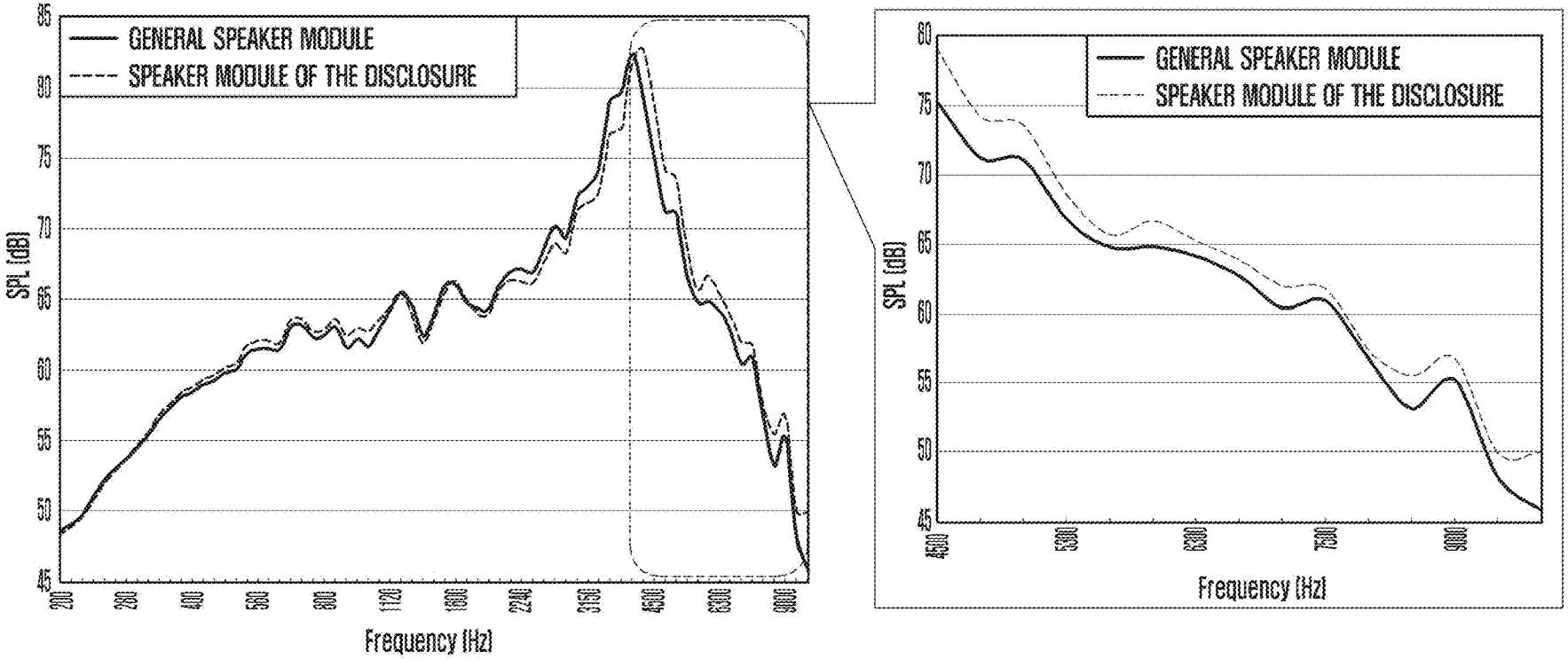
FIG. 12 is a graph of another example comparing the sound performance of an electronic device including a speaker module with that of an electronic device including a general speaker module according to an embodiment of the disclosure.

FIG. 12 is a graph of another example comparing the sound performance of an electronic device including a speaker module according to various embodiments with that of an electronic device including a general speaker module according to an embodiment of the disclosure.

FIG. 12 shows the sound performance of an electronic device including a speaker module having an inclined diaphragm according to various embodiments and that of an electronic device including a general speaker module, measured in a single talk mode (e.g., a speaker mode).

Referring to FIG. 12, the output sound pressure level (SPL) and frequency of an electronic device including a general speaker module were measured, and are indicated by a solid line, while the output sound pressure level and frequency of an electronic device including a speaker module having the inclined diaphragm 450 according to various embodiments were measured, and are indicated by a dotted line.

As noted from FIG. 12, it can be seen that, in a single talk mode of an electronic device such as a smartphone, an electronic device including a speaker module having the inclined diaphragm 450 according to various embodiments has output sound pressure level and high-frequency band superior to those of an electronic device including a non-inclined general speaker module.

Figure 13:
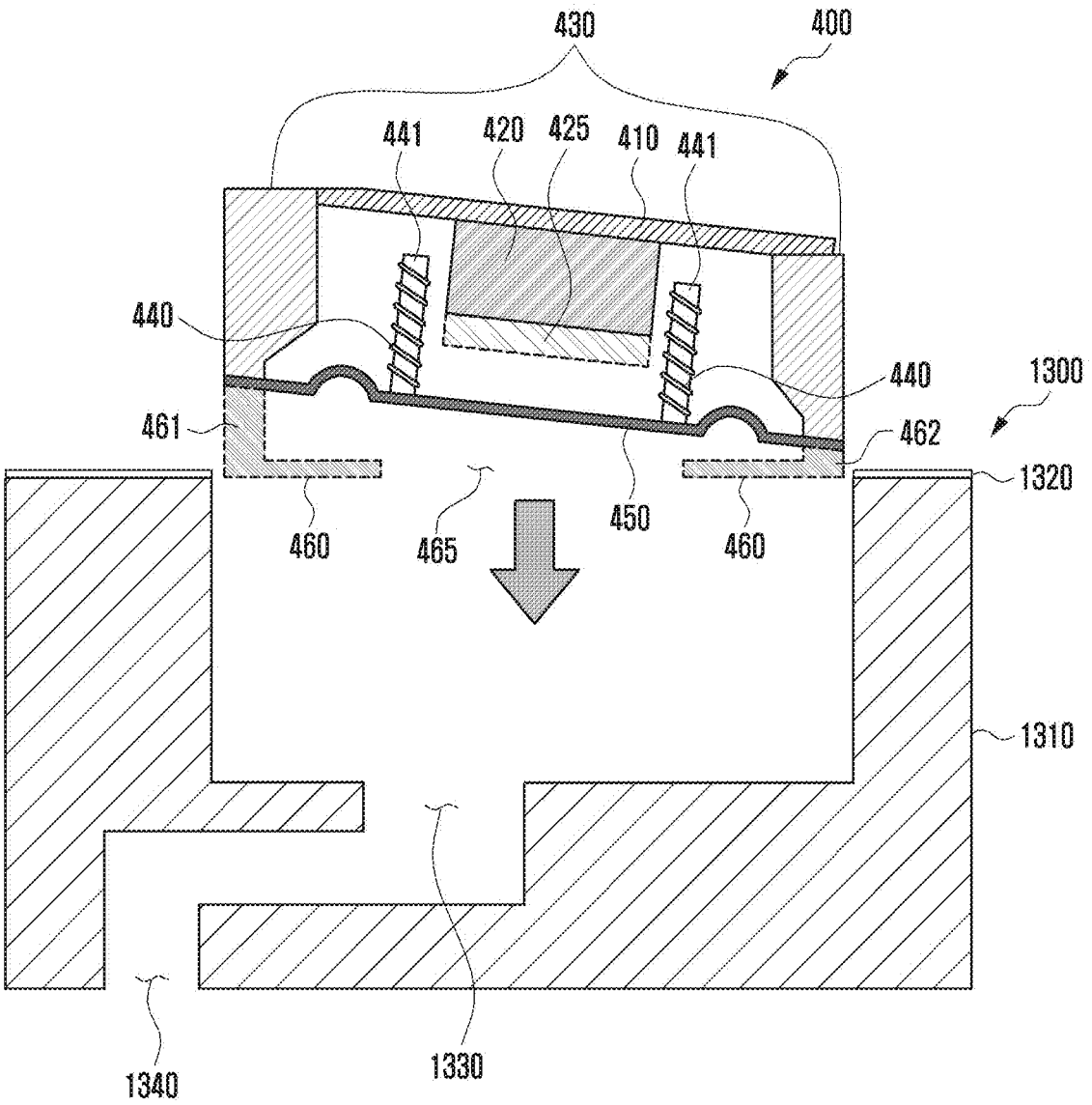
FIG. 13 is a cross-sectional view schematically illustrating a configuration of an electronic device (e.g., a portable communication device) including a speaker module according to an embodiment of the disclosure.

FIG. 13 is a cross-sectional view schematically illustrating a configuration of an electronic device (e.g., a portable communication device) including a speaker module according to an embodiment of the disclosure.

Referring to FIG. 13, an electronic device 1300 (e.g., a portable communication device) according to various embodiments may include any one of the speaker modules 400-1000 shown in FIGS. 4 to 10.

In the description of FIG. 13, descriptions of the same structures and functions as those of the speaker modules 400-1000 illustrated in FIGS. 4 to 10, described above, will be partially omitted.

According to one embodiment, FIG. 13 describes that an electronic device 1300 includes the speaker module 400 described in FIG. 4.

According to one embodiment, the electronic device 1300 of the disclosure may include a housing 1310, a touch display 1320, and the speaker module 400.

According to various embodiments, the housing 1310 (e.g., a housing 110 in FIG. 1) may configure at least a portion of a side surface of the electronic device 1300.

According to various embodiments, the touch display 1320 (e.g., a display 101 in FIG. 1 or a display 330 in FIG. 3) may have at least a portion received in the housing 1310, and may configure at least a portion of one surface (e.g., an upper portion) of the electronic device 1300.

According to various embodiments, the speaker module 400 described in FIG. 4 may be received, for example, in the housing 1310.

According to one embodiment, the speaker module 400 may include the yoke 410, the magnet 420, the frame 430, the voice coils 440, and the diaphragm 450.

According to various embodiments, the yoke 410 may configure one surface (e.g., an upper surface, a first surface) of the speaker module 400. The yoke 410 may fix the magnet 420.

According to various embodiments, the magnet 420 may be arranged such that one surface thereof (e.g., an upper surface, a first surface) is mounted on the yoke 410. The plate 425 may be mounted on another surface (e.g., a lower surface, a second surface) opposite to the one surface of the magnet 420.

According to various embodiments, one end portion (e.g., an upper end portion) of the frame 430 may be connected to the yoke 410. The frame 430 may configure a side surface of the speaker module 400. The frame 430 may configure an outer appearance of the speaker module 400.

According to various embodiments, each of the voice coils 440 may be spaced apart from the magnet 420 and may have at least a portion overlapping the magnet. According to one embodiment, the voice coil 440 may be configured to substantially surround at least a portion of the magnet 420 and the plate 425.

According to various embodiments, the diaphragm 450 may be connected to the voice coil 440. For example, the voice coil 440 may be mounted on an inner surface of the diaphragm 450. The diaphragm 450 may be connected to another end portion (e.g., a lower end portion) opposite to the one end portion of the frame 430 and may be inclined to be non-perpendicular to an outer side surface of the frame 430. The diaphragm 450 may be configured to be inclined in a direction of a speaker hole (e.g., speaker holes 107 and 114 in FIG. 1) in an electronic device (e.g., an electronic device 100 of FIG. 1). According to one embodiment, the diaphragm 450 may be inclined to be non-parallel to the touch display 1320.

According to one embodiment, the housing 1310 may include a first opening 1330 and a second opening 1340.

According to various embodiments, the first opening 1330 formed through one surface (e.g., a lower surface) of the housing 1310 may be oriented toward the speaker module 400. The first opening 1330 may be arranged adjacent to the sound hole 465 disposed in the speaker module 400 (e.g., speaker holes 107 and 114 in FIG. 1).

According to various embodiments, the second opening 1340 may be disposed to allow a sound generated from the speaker module 400 to pass therethrough. The second opening 1340 may be disposed to be oriented toward the first opening 1330. The second opening 1340 may output a sound generated through the sound hole 465 and the first opening 1330 in the speaker module 400 to the outside of the electronic device 1300.

According to various embodiments, the first opening 1330 and the second opening 1340 may be disposed at positions that are not aligned with each other.

According to various embodiments, the first opening 1330 may be disposed on a side surface of the electronic device 1300, depending on the arrangement of the sound hole 465 disposed in the speaker module 400. In this case, the second opening may be disposed to be oriented toward a side surface of the electronic device 1300 in order to easily output a sound generated through the sound hole 465 and the first opening 1330 in the speaker module 400 to the outside of the electronic device 1300.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A speaker module comprising:

a yoke configuring one surface of the speaker module;

a magnet comprising one surface arranged on an inner surface of the yoke;

a frame configuring a side surface of the speaker module and comprising a first end portion connected to the yoke;

a voice coil spaced apart from the magnet and comprising at least a portion overlapping the magnet; and a diaphragm comprising an inner surface on which the voice coil is arranged, wherein the diaphragm is connected to a second end portion opposite of the frame to the first end portion of the frame and is inclined to be non-perpendicular to an outer surface of the frame, and wherein a surface of the magnet facing the inner surface of the yoke is substantially parallel to a portion of the diaphragm overlapping the magnet.

2. The speaker module of claim 1, wherein the yoke is not parallel to the diaphragm, and wherein the yoke is perpendicularly connected to the outer surface of the frame.

3. The speaker module of claim 2, wherein another surface of the magnet is opposite to the diaphragm and is arranged parallel to the diaphragm.

4. The speaker module of claim 3, further comprising a first connection member which is arranged between the one surface of the magnet and the yoke, wherein the one surface of the magnet is inclined with respect to the yoke.

5. The speaker module of claim 1, further comprising a second connection member which is arranged between the voice coil and the diaphragm, wherein a side surface of the magnet is arranged parallel to the outer surface of the frame, and wherein a side surface of the voice coil is parallel to the outer surface of the frame.

6. The speaker module of claim 1, wherein the yoke comprises at least a partial region inclined with respect to the diaphragm.

7. The speaker module of claim 1, further comprising a protection member which comprises a sound hole formed therethrough and is arranged on an outer surface of the diaphragm, wherein a first region of the protection member has a first height, and wherein a second region of the protection member has a second height different from the first height.

8. The speaker module of claim 1, further comprising a mounting ring which is arranged between the frame and the diaphragm, and a fixing ring which is arranged between the voice coil and the diaphragm and between the frame and the diaphragm.

* * * * *